United States Patent [19]

Nuncio

[11] Patent Number: 4,640,075

[45] Date of Patent: Feb. 3, 1987

[54] CONTAMINANT SEALING SYSTEM AND METHOD

[76] Inventor: Theodore Nuncio, 1405 S. Olathe Way, Aurora, Colo. 80017

[21] Appl. No.: 818,204

[22] Filed: Jan. 13, 1986

[51] Int. Cl.[4] ..... E04B 5/52

[52] U.S. Cl. ..... 52/484; 52/126.1; 52/465

[58] Field of Search ..... 52/484, 126.1, 126.5, 52/459, 465, 460, 461, 463, 468, 469, 488, 489, 664, 665, 39

[56] References Cited

U.S. PATENT DOCUMENTS

| | | | |
|---|---|---|---|
| 2,981,386 | 4/1961 | Reske et al. | 52/484 |
| 3,216,537 | 11/1965 | Nelsson | 52/484 X |
| 3,253,082 | 5/1966 | Buset | 52/484 X |
| 3,329,387 | 7/1967 | Fischer | 52/484 X |
| 4,019,300 | 4/1977 | Sauer | 52/484 X |
| 4,294,054 | 10/1981 | Kuhr | 52/484 |
| 4,570,391 | 2/1986 | Quante et al. | 52/484 X |
| 4,583,340 | 4/1986 | Sauer | 52/484 |

FOREIGN PATENT DOCUMENTS

| | | | |
|---|---|---|---|
| 343612 | 2/1960 | Switzerland | 52/484 |
| 359271 | 2/1962 | Switzerland | 52/485 |
| 1200630 | 7/1970 | United Kingdom | 52/484 |

*Primary Examiner*—J. Karl Bell

*Attorney, Agent, or Firm*—Norvell E. Von Behren; Donna J. Thies

[57] ABSTRACT

A contaminant sealing system which may be utilized to enclose dust and other contaminants such as asbestos in an area between the roof and ceiling of a building. The contaminant sealing system utilizes a new and novel suspended ceiling comprising a plurality of ceiling tile frames, and a plurality of ceiling tiles which are positioned within the ceiling tile frames by way of an attaching mating means such that the cell which is formed is sealed to prevent the passing of dust or other contaminants through the cells. The plurality of cells are connected to each other and sealing means are provided in the form of seam covers to prevent dust or contaminants from passing through the connection between the cells. A plurality of X-shaped braces are positioned partially over the seam covers and are fixedly attached to the corners of the ceiling tile frames to reinforce the entire structure. Hanging means are provided for hanging the ceiling structure to an existing overhead ceiling joist, thereby providing a suspended ceiling which encloses dust or other contaminants from the remainder of the room. Also disclosed is a modification of the contaminant sealing system which utilizes a metal hood which is attached to the top portion of the plurality of ceiling tiles and each metal hood thereby prevents the passing of radio waves or the like through the ceiling and into the room. Also disclosed is a new and novel method for sealing dust and contaminants and enclosing the dust and contaminants within an area between the roof and ceiling of a building.

28 Claims, 11 Drawing Figures

CONTAMINANT SEALING SYSTEM AND METHOD

BACKGROUND OF THE INVENTION

The problem of providing a contaminant-free environment or "clean room" has long been known in such applications as computer centers and hospitals. In addition, the asbestos problem is now well known by the general population. Currently, many hospitals, schools, universities, office buildings and institutions are plagued by asbestos related problems. Asbestos was previously considered a health hazard only for asbestos workers. Now asbestos is known to be a potential danger to many people who are routinely exposed to asbestos fibers in the air they breathe. Those who may be endangered by asbestos are children, teachers and others in schools, office buildings or the like where asbestos was sprayed or troweled on ceilings and other structural parts of buildings for fire-proofing, insulation, sound deadening or decoration. With regard to the asbestos problem, an effort has been made by the E.P.A. and O.S.H.A. to control the dust of tiny asbestos fibers, particularly where they are present in schools.

The E.P.A. and O.S.H.A. have issued regulations which cover the removal, encapsulation and enclosure of the asbestos material. Removal of asbestos containing material requires actual removal from the building by qualified professional personnel and the material is disposed of by burial in a site specifically approved for asbestos. Encapsulation of asbestos containing material requires that the area be coated with a penetrating bonding sealant to prevent release of asbestos fibers into the air. Enclosure of asbestos containing material requires that there be physical separation from the building environment by means of erecting permanent barriers such as suspended ceilings. The present invention relates to a contaminant sealing system which would satisfy the requirements of enclosure of the asbestos containing material. Removal of the asbestos containing material has the advantages of eliminating the source of the asbestos and it ends the exposure and precludes the development of future problems. However, removal has the disadvantages of being the most costly, complicated and time-consuming method; replacement of the removed material with a substitute material may be necessary; and there is a higher potential of exposure for workers to asbestos hazards. Enclosure has the advantages of controlling fiber released and it is the most rapid practical and uncomplicated method. In the case of enclosure, the source of the asbestos remains in the building, but the enclosure method is most appropriate when removal is not feasible for financial, practical or other reasons, and when disturbance of the enclosed areas is not likely.

The present invention relates to an enclosing system and method whereby ceiling tile frames are provided with a receiving means for receiving ceiling tiles such that there is sealing between the ceiling tile frame and the ceiling tile. This ceiling tile frame and ceiling tile form one cell of the system and there is also provided means for sealing between the cells in the system. In this way, the contaminant is sealed in an area between the roof and the ceiling of a building.

Prior art devices and systems do not consider the problem of a contaminant and dust-free environment. The present invention overcomes this problem by providing sealing within each cell in the system and providing sealing between all the cells in the system.

U.S. Pat. No. 4,075,811 to Keith discloses a building roof panel used in the construction of portable buildings. Two adjacent panels can be bolted together with the aid of a U-shaped channel used to clamp the panels together. The purpose of the panel is to provide a panel which can be assembled with other panels at the construction site by a simple bolting process so that a joint is sealed and protected from the weather. This structure does not provide for the enclosure and containment of dust and other contaminants.

U.S. Pat. No. 3,857,212 to Barnett discloses hub joints for geodesic domes. Panels are provided and the space between the panels has a T-strut and caulking with a sealing strip along the length of the T-strut to provide a weather seal. Barnett is also concerned with weather sealing and not the enclosure or containment of dust and other contaminants.

U.S. Pat. No. 3,823,518 to Allen teaches a reinforcing fiberglass plastic roof for boxcars. The roof of a boxcar is reinforced by X-shaped ends traversly extending and lengthwise spaced ribs made of fiberglass plastic.

U.S. Pat. No. 3,760,544 to Hawes et al discloses a sealing gasket for installing between adjacent panel sections of wall structures to seal and insulate. Hawes et al is concerned with the expansion and contraction of the panels due to changes in temperature. In a like manner, Hawes et al is not concerned with the enclosure or containment of dust or other contaminants.

U.S. Pat. No. 1,959,766 to Sayler discloses a wall structure with an outer sheet, an inner sheet and filler material interposed between the two sheets.

U.S. Pat. No. 1,825,154 to McDermott teaches a lining for high temperature vessels whereby a plurality of panels are attached to ajoining panels by the use of plates having flanged upturned edges.

U.S. Pat. No. 718,302 to Bartelstone discloses a reflective wall or ceiling where panels are connected by strips extending along the adjacent edges between the panels.

U.S. Pat. No. 364,251 to Heberling discloses a metal roof provided with capping for the seams in the metal roof.

SUMMARY OF THE INVENTION

In order to overcome problems and difficulties inherent in the prior art devices, there has been provided by the subject invention, a new and novel contaminant sealing system and method of sealing contaminants which may be utilized in any environment where control of dust and other contaminants is desired. Also disclosed is a modification of the subject invention which allows sealing of the ceiling against radio waves and the like.

In the contaminant sealing system there is employed a new and novel plurality of cells which are tightly sealed within each cell and the connection between any two of the cells is also accomplished.

The subject new and novel contaminant sealing system is designed to eliminate the passing of dust and other contaminants, such as asbestos below the ceiling. After installing the new and novel contaminant sealing system, dust and contaminants are enclosed in an area between the roof of a building and the ceiling, away from people or machines which could be damaged by the dust or other contaminants.

Accordingly, it is an object of the invention to provide a new and improved contaminant sealing system that is capable of enclosing dust and other contaminants in an area away from where it could cause damage.

Yet another object of the invention is to provide a new and novel contaminant sealing system which is relatively economical and practical to install.

Still yet another object of the invention is to provide an improved method of enclosing contaminants within an area between the roof of a building and the ceiling.

Another object of the invention is to seal a room against dust or contaminants where it is highly desirable or required such as a computer room or a hospital room.

A further object of the invention is to provide a new and novel contaminant sealing system which would enclose asbestos dust away from people who would be otherwise exposed, such as a school.

Another object of the modification of the new and novel contaminant sealing system is to provide a sealing system which will protect a room from the bombardment of radio waves and the like where this is desirable, such as in a computer room.

These and other objects and advantages of the invention will become apparent after a review of the drawings and a study of the description of the preferred embodiment.

DESCRIPTION OF THE PREFERRED EMBODIMENT

Figure 1:
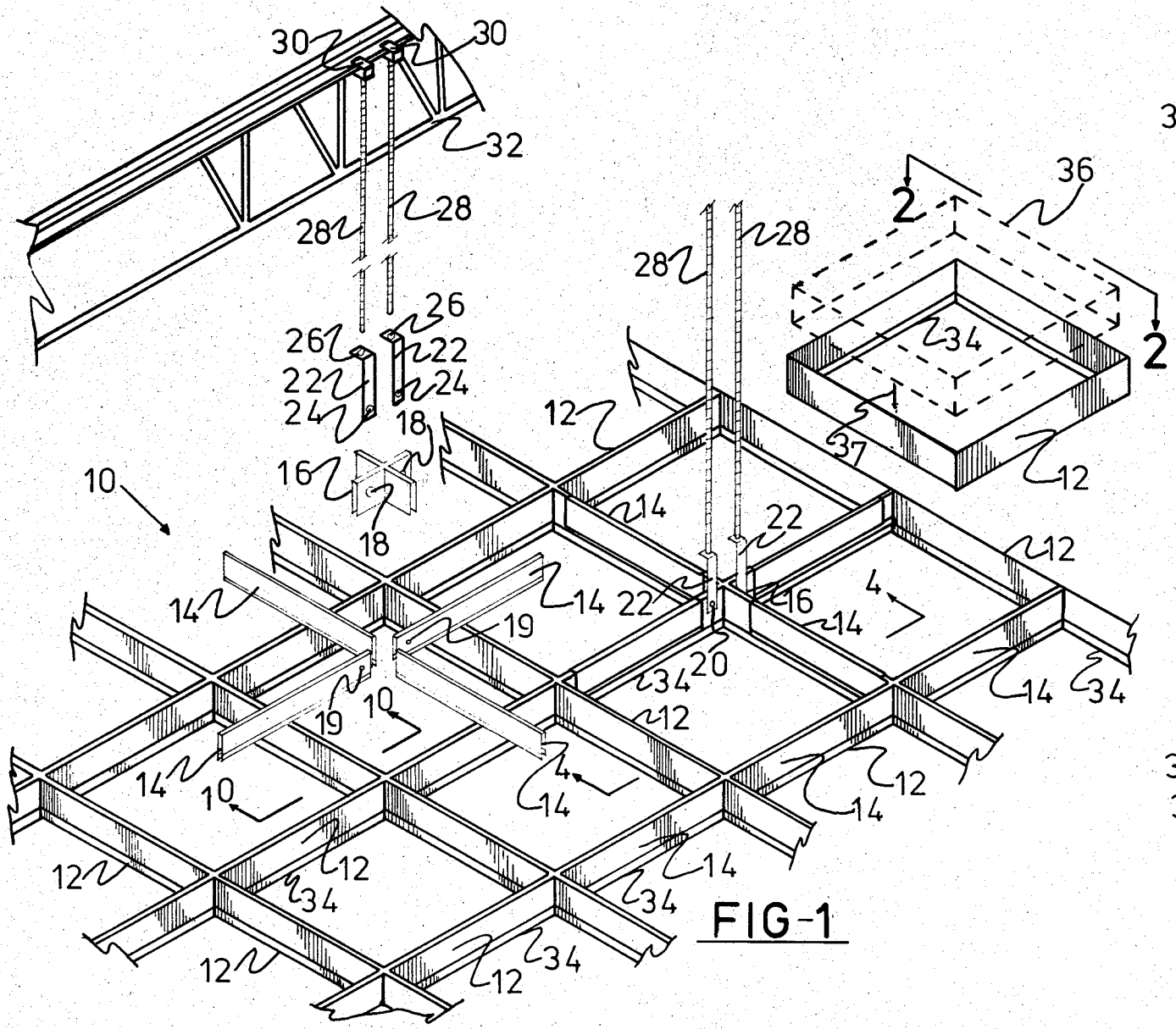
FIG. 1 is a perspective view shown partially exploded of the new and novel contaminant sealing system of the subject invention, and also shown for purposes of clarity is a separate cell removed from the system.

Referring now to the drawings in general and in particular to FIG. 1 of the drawings, there is shown a perspective of the subject contaminant sealing system, shown generally by numeral 10, which comprises a plurality of ceiling tile frames 12 which are connected together. Sealing means in the form of seam covers 14 are provided to seal the space between any two adjacent plurality of ceiling tile frames 12 to prevent contaminants from passing between each of the plurality of ceiling tile frames 12. X-shaped braces 16 are positioned partially over the seam covers 14 and are fixedly attached to the corners of the ceiling tile frame 12 to further prevent contaminants from passing between the plurality of ceiling tile frames 12 and to reinforce the contaminant sealing system. Each X-shaped brace 16 is provided with holes 18 and a bolt/nut 20, not shown in FIG. 1 for purposes of clarity. The X-shaped braces 16 are attached to the corners of the ceiling tile frames 12 by use of the bolt/nut 20, not shown in FIG. 1, which goes through the X-shaped brace 16, the seam cover 14, and the ceiling tile frame 12. A height adjustment bracket 22 is attached to one of the X-shaped braces 16. The height adjustment bracket 22 has an upper hole 26 and a lower hole 24. The X-shaped brace 16 is attached to the height adjustment bracket 22 at the lower hole 24 of the height adjustment bracket 22. The height adjustment bracket 22 is then attached at the other end to a threaded rod 28. The height adjustment bracket 22 is attached to the threaded rod 28 at the upper hole 26 in the height adjustment bracket 22. A plurality of beam clamps 30 are provided such that the beam clamps 30 are attached at one end to one of the threaded rods 28 and attached at the clamp end to an existing bar joist 32. On the right side of FIG. 1, there is shown a single cell of the contaminant sealing system shown removed from the rest of the system for purposes of clarity. A single cell of the system comprises a ceiling tile frame 12 and a ceiling tile 36. The ceiling tile 36 is shown in dashed lines in FIG. 1 before it has been inserted into the ceiling tile frame 12. A protuberance 34 is provided on the ceiling tile frame 12 such that the ceiling tile 36 can be inserted into the ceiling tile frame 12 in a downward direction as shown by arrow 37 in FIG. 1. The ceiling tile 36 is provided with a mating groove 38 so that the ceiling tile 36 is mated to the ceiling tile frame 12 with a sealed connection so that contaminants are prevented from passing through the cell.

It is contemplated by the subject invention and within the spirit and scope of the present contaminant sealing system that other forms could be used to seal the contaminants from passing through a single cell other than the mating means provided in the preferred embodiment. This could employ, for example, the use of a sealing gasket between frames and the frames being bolted together; a sealing tape could be used in lieu of the ceiling tile groove; other adhesive means could be used to seal or numerous other variations could be used to effect sealing within any individual cell.

Figure 2:
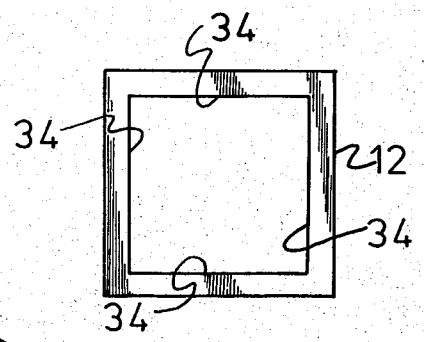
FIG. 2 is a top view showing one of the cells of the new and novel contaminant sealing system taken along line 2—2 of FIG. 1.

Referring now to FIG. 2 of the drawings, there is shown a top view of a single cell in the system before a ceiling tile has been inserted. Before the ceiling tile is inserted, the cell comprises a ceiling tile frame 12 having a protuberance 34 which provides the male mating means used to mate the ceiling tile frame 12 to the ceiling tile.

Figure 3:
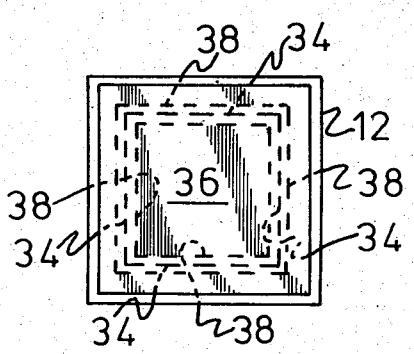
FIG. 3 is a top view similar to FIG. 2 showing one of the cells of the contaminant sealing system with a ceiling tile installed by means of applicant's new and novel mating means.

FIG. 3 is a top view similar to FIG. 2 showing the ceiling tile 36 installed. The ceiling tile 36 is positioned into the ceiling tile frame 12 by use of the protuberance 34 provided on the ceiling time frame 12 mating with the grove 38.

Figure 4:
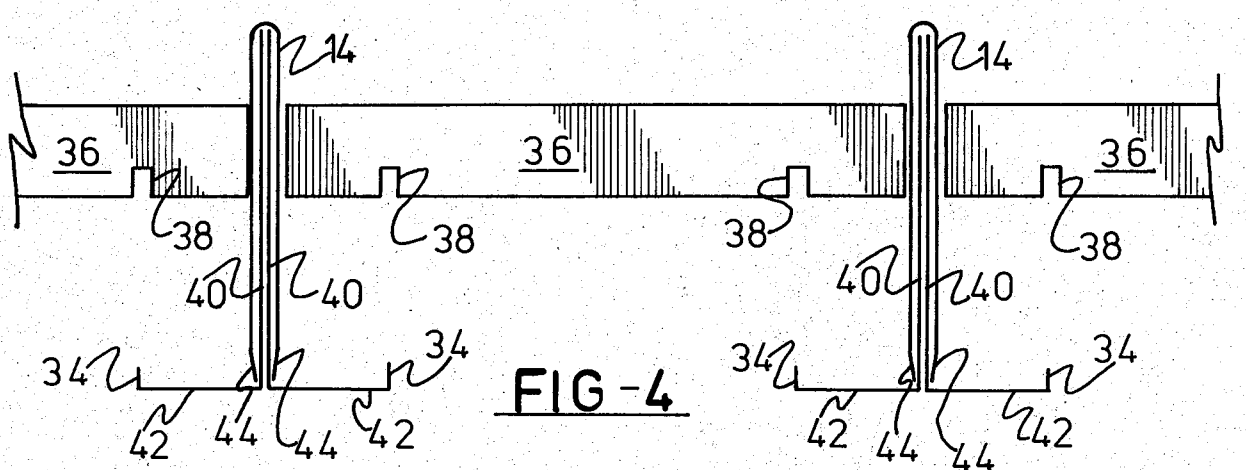
FIG. 4 is a cross-sectional view, taken along line 4—4 of FIG. 1, showing a plurality of cells in the contaminant sealing system in position and the ceiling tile in a position prior to assembly.

FIG. 4 is a cross-sectional view, taken along line 4—4 of FIG. 1, showing a plurality of cells in position and showing the ceiling tiles 36 in a position prior to assembly. Shown in FIG. 4 are a plurality of seam covers 14 positioned over the ceiling tile frame side 40. The ceiling tile frame bottom 42 is shown adjacent to the seam cover turned ends 44 such that the seam cover 14 is provided with a turned end 44 so that contaminants are prevented from passing through the space between any two cells.

Figure 5:
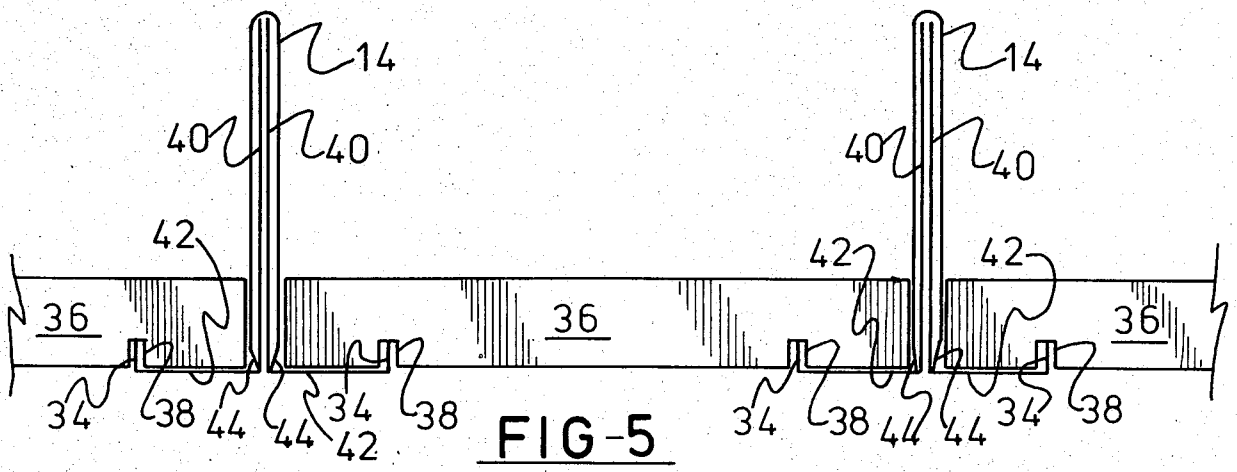
FIG. 5 is a cross-sectional view, similar to FIG. 4, showing the ceiling tile in position after assembly and mated together by use of the mating means.

FIG. 5 is a cross-sectional view, similar to FIG. 4 showing the ceiling tiles 36 in position and the mating means of the ceiling tile 36 and the bottom of the ceiling tile frame 42 as they are mated. Each ceiling tile 36 is provided with four ceiling tile grooves 38 and each bottom of the ceiling time frame 42 is provided with four protuberances 34. The grooves on the ceiling tile 38 receive the protuberances 34 on the bottom of the ceiling tile frame 42 providing a mating means, such that contaminants are prevented from passing through any one of the cells of the system. The grooves 38 and the protuberances 34 are continuous around the ceiling tile 36 and the ceiling tile frame 42. Also shown in FIG. 5 are a plurality of seam covers 14 as they are positioned over the sides of the ceiling tile frame 40. Each seam cover 14 has turned ends 44 such that the seam between any two of the cells is covered and thus, contaminants are prevented from passing between any two adjacent cells.

Figure 6:
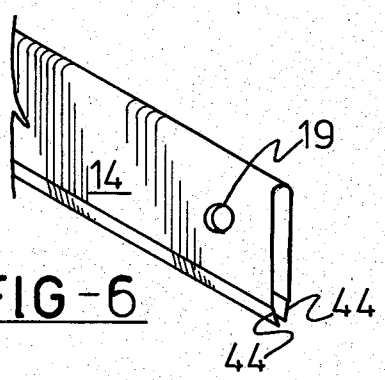
FIG. 6 is a perspective view of applicant's new and novel sealing means in the form of seam covers as they are provided to seal a connection between any two adjacent ceiling tile frames.

FIG. 6 is a perspective view of one of the seam covers 14 and the turned end of the seam cover 44 is shown in greater detail. The seam cover 14 is used to hold individual cells together to prevent contaminants from going through between any two adjacent cells and is thereby a contaminant sealer.

Figure 7:
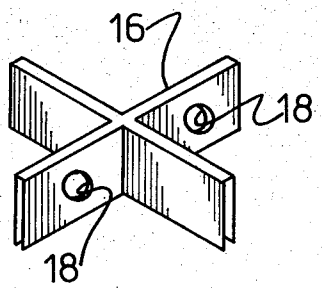
FIG. 7 is a perspective view of an X-shaped brace used to prevent contaminants from passing between corners of the ceiling tile frames and to reinforce the contaminant sealing system.
Figure 8:
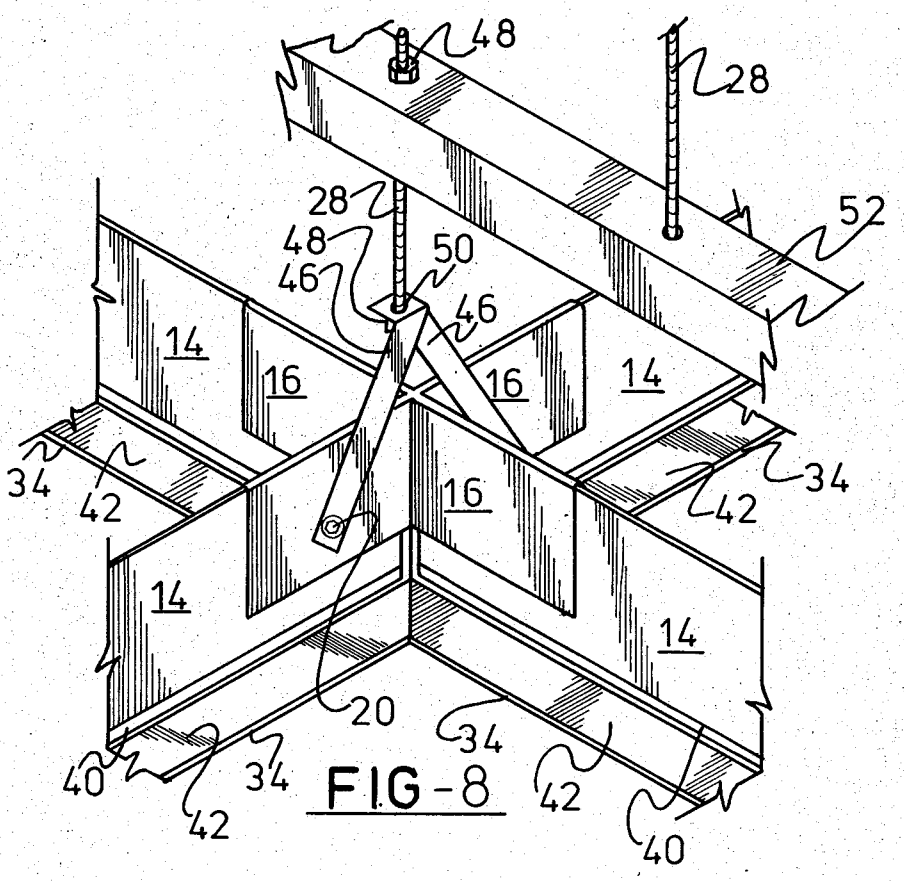
FIG. 8 is an enlarged perspective view showing the installation of the X-shaped braces on the corners of the ceiling tile frames and showing a modified adjustment bracket and a modified way of hanging the entire ceiling.

FIG. 7 is a perspective view of an X-shaped brace 16 which is positioned partially over the seam cover 14 in FIG. 6, and is attached to the corners of the plurality of ceiling tile frames. Each X-shaped brace 16 is provided with two holes 18 for attaching the X-shaped brace 16 to the corners of the ceiling tile frames and for positioning the X-shaped braces 16 partially over the seam covers 14 as shown in FIG. 8. As explained with reference to FIG. 1, a bolt/nut 20, not shown in FIG. 1 for purposes of clarity, goes through hole 18 in FIG. 7 and through seam cover hole 19 in FIG. 6, and through the ceiling tile frame 12 in FIG. 1, and is then secured by the nut portion of 20 on the other side of the connection.

FIG. 8 is an enlarged perspective view showing the installation of the X-braces 16 positioned partially over the seam covers 14 on the corners of the ceiling tile frames and also showing a modified height adjustment bracket 46 and a modified way of hanging the entire ceiling structure. In the modified embodiment shown in FIG. 8, there is shown a modified height adjustment bracket 46 which has at its upper part, a hole 50; through hole 50 is inserted a threaded rod 28 and attached to the threaded rod 28 on the other side of the hole 50 in the modified height adjustment bracket 46 is a nut 48 for securing the threaded rod 28 through the modified height adjustment bracket 46. The other end of the threaded rod 28 is inserted through a separate channel 52 and the nut 48 is also used to secure the other end of the threaded rod to the channel 52. The modified embodiment of FIG. 8 employs an extra separate channel 52 that may be required to stablize the structure in unusual circumstances such as the existance of an extremely high ceiling.

Figure 9:
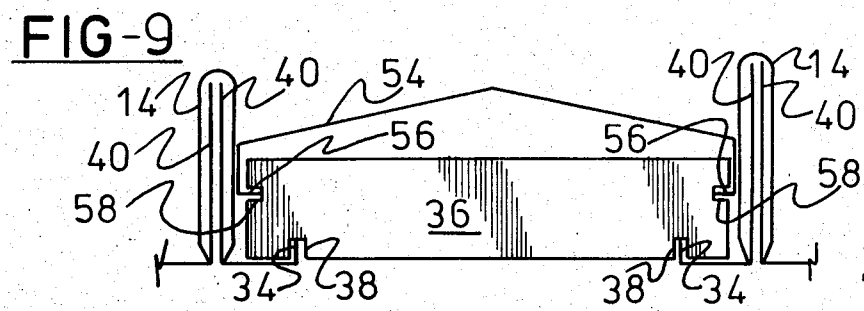
FIG. 9 is a single line side view showing the applicant's new and novel invention modified with a radio shield means.

FIG. 9 shows a single line side view of the basic invention as it is modified with a radio shield means. In the embodiment shown in FIG. 9, there is shown a ceiling tile 36 having a ceiling tile groove 38 which receives the protuberance on the ceiling tile frame 34 to seal the ceiling tile 36 to the ceiling tile frame. Also shown in FIG. 9 are seam covers 14 positioned over the ceiling tile frame sides 40 to effect a seal between any two adjacent cells. The modification of FIG. 9 includes a radio shield 54 having a protuberance on the shield 56. The ceiling tile 36 is provided with a complimentary groove 58 on the sides of the tile 36 for receiving the protuberance 56 of the radio shield 54. In this manner, mating means are provided for the radio shield means such that a tight seal is effected within each of the modified cells.

Figure 10:
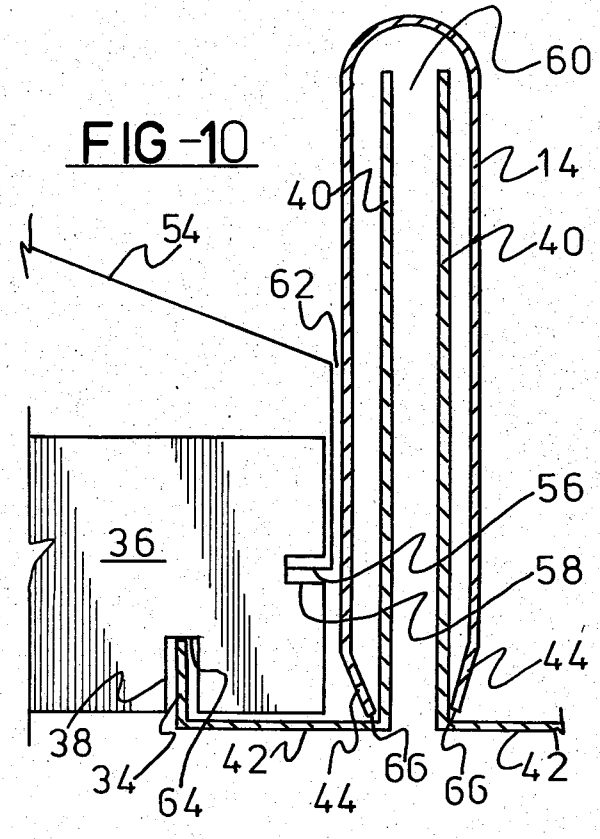
FIG. 10 is an enlarged cross-sectional view, taken through line 10—10 of FIG. 1, showing one of the cells in the contaminant sealing system with the modified radio shield installed.

FIG. 10 is an enlarged cross-sectional view taken through line 10—10 of FIG. 1 showing a cell with the modified radio shield installed. FIG. 10 has been greatly enlarged for purposes of illustration to show applicant's new and novel way to seal contaminants. Shown in FIG. 10, greatly enlarged, is the space 60 between any two adjacent ceiling tile frames 12. The seam cover 14 is shown as it covers the seam between any two adjacent ceiling tile frames and also shown in greater detail are the turned ends of the seam cover 44 as they are used to seal the space between any two adjacent ceiling tile frames and the sealing point of the turned up ends 44 of the seam cover 14 is shown at 66. Also shown in FIG. 10 is the space between the ceiling tile 36 and the seam cover 14 shown at 62 and the sealing point in the ceiling tile groove 38 is shown at 64. FIG. 10 has been enlarged to show that contaminants ordinarily could leak through points 60, 62 or 64. Mating means in the form of a ceiling tile frame protuberance 34 and a receiving ceiling tile groove 38 have been provided to prevent contaminants from leaking past points 62 to point 64. A seam cover 14 with turned-up ends 44 has been provided to prevent contaminants from leaking past point 66 and between frame 12 at point 60.

Figure 11:
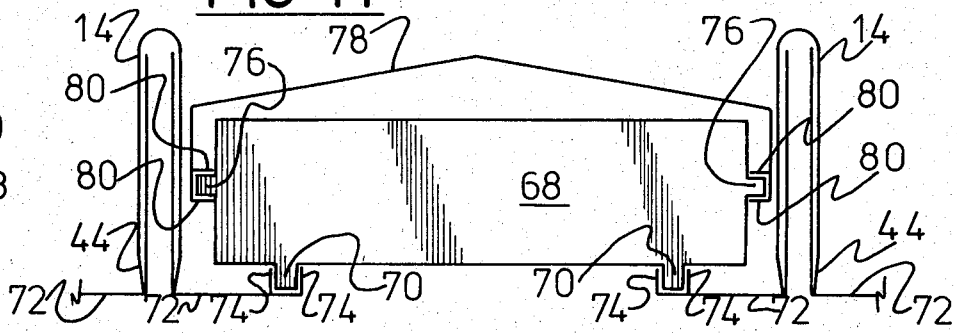
FIG. 11 is an enlarged single line side view showing a modification of the mating means and the radio shield means.

FIG. 11 is an enlarged single line side view showing a modification of the mating means and the radio shield. In the embodiment of FIG. 11, there is shown a modified ceiling tile 68 which has a male portion 70 on the bottom. In the embodiment of FIG. 11, there is a modified ceiling tile frame 72 which carries the female mating portion 74. Also shown on the modified ceiling tile 68 is a male portion 76 on the side of the modified ceiling tile 68. In the modified embodiment of FIG. 11, there is provided a modified radio shield 78 which has the female portion 80 for receiving the modified ceiling tile 68. Other combinations or variations of the various mating means are within the spirit and scope of the subject invention. The present invention also includes a method for sealing contaminants which comprises providing a plurality of ceiling tile frames, providing a plurality of ceiling tiles, providing mating means for attaching the plurality of ceiling tiles to the plurality of ceiling tile frames, positioning the plurality of ceiling tiles within the plurality of ceiling tile frames, providing a sealing means for preventing contaminants from passing between each of the plurality of adjacent ceiling tile frames, providing a plurality of X-shaped braces, positioning the plurality of X-shaped braces partially over the sealing means and fixedly attaching the X-shaped braces to the corners of the plurality of ceiling tile frames, providing a plurality of height adjustment brackets, attaching the plurality of height adjustment brackets to the plurality of X-shaped braces, providing a plurality of threaded rods, attaching one end of the plurality of threaded rods to the plurality of height adjustment brackets, providing a plurality of beam clamps, attaching one end of the plurality of threaded rods to the plurality of height adjustment brackets and the other end of the plurality of threaded rods to the plurality of beam clamps, and the beam clamps are attached to an existing overhead ceiling joist thereby providing a suspended ceiling which prevents contaminants from passing below the ceiling. In this method of containing contaminants, the contaminants are enclosed in an area above the ceiling and below the roof of a building. If it is desired to keep radio interference out of a room or a building, a modification to the method can include further providing a plurality of metal hoods and attaching the plurality of metal hoods to the top portion of each of the plurality of ceiling tiles whereby each of the plurality of metal hoods would enclose each of the plurality of ceiling tiles to prevent the passing of radio waves through each of the plurality of ceiling tile frames.

It should become apparent that there are other ways of providing a sealing mating means between the ceiling tile and the ceiling tile frame; there can be changes in the manner of holding the radio shield to the ceiling tile frame; and there could be other mating means provided between adjacent ceiling tile frames without departing from the spirit and scope of the invention and the invention is not to be limited to the preferred embodiment, which has been given by way of illustration only.

The assembled ceiling system shown in FIG. 1 could also be constructed in other basic cell shapes such as triangular, rectangular or others within the spirit and scope of the invention. In the FIG. 1 illustration it should be clearly understood that in the preferred embodiment shown each adjacent frame 12 has a seam cover 14 installed and each corner of adjacent frames 12 has an X-brace 16 installed. FIG. 1 shows only a few of these items for purposes of clarity in illustrating applicant's novel contaminant sealing system.

Having described my invention, I claim:

1. A contaminant sealing system for a building, comprising:

(a) a plurality of ceiling tile frames having sides and corners;

(b) a plurality of ceiling tiles having a top portion and a bottom portion positioned within the plurality of ceiling tile frames;

(c) mating means, associated with each frame and ceiling tile, for attaching the plurality of ceiling tiles to the plurality of ceiling tile frames;

(d) sealing means, associated with the ceiling tile frames, for preventing contaminants from passing between each of the plurality of ceiling tile frames;

(e) a plurality of X-shaped braces positioned partially over the sealing means and fixedly attached to the corners of the plurality of ceiling tile frames to prevent contaminants from passing between the plurality of ceiling tile frames and to reinforce the contaminant sealing system;

(f) a plurality of height adjustment brackets attached to the plurality of X-shaped braces;

(g) a plurality of threaded rods having two ends and positioned at one end within the plurality of height adjustment brackets and fixedly attached thereto;

(h) a plurality of beam clamps attached to the plurality of threaded rods at the end of the threaded rods opposite to the plurality of brackets and fixedly attached thereto; and (i) whereby the plurality of beam clamps are attached to an overhead ceiling joist thereby providing a suspended ceiling which allows containment of contaminants within an area above the ceiling system.

2. The contaminant sealing system as defined in claim 1 wherein the sealing means are seam covers provided to seal a connection between any two adjacent plurality of ceiling tile frames.

3. The contaminant sealing system as defined in claim 1 further comprising nuts and bolts provided for bolting the plurality of X-shaped braces to the sealing means and to the plurality of ceiling tile frames.

4. The contaminant sealing system as defined in claim 1 wherein the ceiling tiles are a high-density, polyethelene, non-fibrous material.

5. The contaminant sealing system as defined in claim 1 wherein the mating means comprises a male mating means positioned on the plurality of ceiling tile frames and a female mating means positioned on the bottom portion of the plurality of ceiling tiles.

6. The contaminant sealing system as defined in claim 1 wherein the mating means comprises a female mating means positioned on the plurality of ceiling tile frames and a male mating means positioned on the bottom portion of the plurality of ceiling tiles.

7. The contaminant sealing system as defined in claim 1 further comprising;

(j) a plurality of metal hoods attached to the top portion of each of the plurality of ceiling tiles and each of the plurality of metal hoods thereby enclosing each of the plurality of ceiling tiles to act as a radio shield means to prevent the passing of radio waves and the like through each of the plurality of ceiling tile frames.

8. The contaminant sealing system as defined in claim 7 wherein each of the plurality of metal hoods has a male mating means for attaching the plurality of metal hoods to the plurality of ceiling tiles and each of the plurality of ceiling tiles has a female mating means for receiving each of the plurality of metal hoods.

9. The contaminant sealing system as defined in claim 7 wherein each of the plurality of ceiling tiles has a male mating means for attaching the plurality of ceiling tiles to the plurality of metal hoods and each of the plurality of metal hoods has a female mating means for receiving each of the plurality of ceiling tiles.

10. A contaminant sealing cell, comprising;

(a) a ceiling tile frame having sides and corners;

(b) a ceiling tile having a top portion and a bottom portion positioned within the ceiling tile frame;

(c) mating means, associated with the frame and the tile, for attaching the ceiling tile to the ceiling tile frame; and (d) whereby the ceiling tile is positioned within the ceiling tile frame and a tight seal between the ceiling tile and the ceiling tile frame is provided by the mating means.

11. The contaminant sealing cell as defined in claim 10 wherein the mating means comprises a male mating means positioned on the ceiling tile frame and a female mating means positioned on the bottom portion of the ceiling tile.

12. The contaminant sealing cell as defined in claim 10 wherein the mating means comprises a female mating means positioned on the ceiling tile frame and a male mating means positioned on the bottom portion of the ceiling tile.

13. The contaminant sealing cell as defined in claim 10 wherein the ceiling tile is a high-density, polyethelene, non-fibrous material.

14. The contaminant sealing cell as defined in claim 10 further comprising:

(e) a metal hood attached to the top portion of the ceiling tile, the metal hood thereby enclosing the ceiling tile to act as a radio shield means to prevent the passing of radio waves and the like through the ceiling tile frame.

15. The contaminant sealing cell as defined in claim 14 wherein the metal hood has a male mating means for attaching the metal hood to the ceiling tile and the ceiling tile has a female mating means for receiving the metal hood.

16. The contaminant sealing cell as defined in claim 14 wherein the ceiling tile has a male mating means for attaching the ceiling tile to the metal hood and the metal hood has a female mating means for receiving the ceiling tile.

17. A method of sealing contaminants comprising:

(a) providing a plurality of ceiling tile frames having sides and corners;

(b) providing a plurality of ceiling tiles having a top portion and a bottom portion positioned within the plurality of ceiling tile frames;

(c) providing mating means for attaching the plurality of ceiling tiles to the plurality of ceiling tile frames;

(d) positioning the plurality of ceiling tiles within the plurality of ceiling tile frames and securing the mating means to seal the plurality of ceiling tiles to the plurality of ceiling tile frames;

(e) providing a sealing means for preventing contaminants from passing between each of the plurality of adjacent ceiling tile frames;

(f) providing a plurality of X-shaped braces;

(g) positioning the plurality of X-shaped braces partially over the sealing means and fixedly attaching the X-shaped braces to the corners of the plurality of ceiling tile frames to prevent contaminants from passing between the plurality of ceiling tile frames and to reinforce the entire structure;

(h) providing a plurality of height adjustment brackets;

(i) attaching the plurality of height adjustment brackets to the plurality of X-shaped braces;

(j) providing a plurality of threaded rods having two ends;

(k) attaching one end of the plurality of threaded rods to the plurality of height adjustment brackets;

(l) providing a plurality of beam clamps;

(m) attaching the end of the plurality of threaded rods opposite to the plurality of height adjustment brackets to the plurality of beam clamps; and (n) whereby the plurality of beam clamps are attached to an overhead ceiling joist thereby providing a suspended ceiling which allows containment of contaminants within an area above the ceiling and below the roof of a building.

18. The method of sealing contaminants as defined in claim 17 wherein the mating means of step C comprises a male mating means positioned on the plurality of ceiling tile frames and a female mating means positioned on the bottom portion of the plurality of ceiling tiles.

19. The method of sealing contaminants as defined in claim 17 wherein the mating means of step C comprises a female mating means positioned on the plurality of ceiling tile frames and a male mating means positioned on the bottom portion of the plurality of ceiling tiles.

20. The method of sealing contaminants as defined in claim 17 further comprising the steps of:

(o) providing a plurality of metal hoods; and (p) attaching the plurality of metal hoods to the top portion of each of the plurality of ceiling tiles and each of the plurality of metal hoods thereby enclosing each of the plurality of ceiling tiles to prevent the passing of radio waves and the like through each of the plurality of ceiling tile frames.

21. The method of sealing contaminants as defined in claim 20 wherein each of the plurality of metal hoods has a male mating means for attaching the plurality of metal hoods to the plurality of ceiling tiles and each of the plurality of ceiling tiles has a female mating means for receiving each of the plurality of metal hoods.

22. The method of sealing contaminants as defined in claim 20 wherein each of the plurality of ceiling tiles has a male mating means for attaching the plurality of ceiling tiles to the plurality of metal hoods and each of the plurality of metal hoods has a female mating means for receiving each of the plurality of ceiling tiles.

23. A contaminant sealing system for use inside a building, comprising:

(a) a plurality of adjacently positioned ceiling tile frames;

(1) a plurality of ceiling tiles having a top portion and a bottom portion positioned within each of the plurality of ceiling tile frames;

(2) mating means, associated with each frame and ceiling tile for attaching the plurality of ceiling tiles to the plurality of ceiling tile frames; the mating means serving to prevent airborne contaminants from passing around the ceiling tile from the top of the ceiling tile to the area below the bottom portion of the ceiling tile;

(b) sealing means, associated with the adjacent ceiling tile frames, for preventing contaminants from passing between the adjacent ceiling tile frames; and (c) hanging means, associated with the adjacent ceiling tile frames and the building, for hanging the contaminant sealing system from the interior portions of the building; the sealing system thereby providing a suspended ceiling for inside a building which allows containment of contaminants within the area above the ceiling system.

24. The contaminant sealing system as defined in claim 23 further comprising:

(d) adjusting means, associated with the hanging means, for adjusting the position of the suspended ceiling from the building floor.

25. The contaminant sealing system as defined in claim 23 further comprising:

(d) radio shielding means, associated with the plurality of ceiling tiles, for shielding radio waves from passing into the area below the bottom portion of the ceiling tile.

26. A method of sealing contaminants within a building, comprising:

(a) providing a plurality of ceiling tile frames having sides and corners; the frames being fixedly attached together;

(b) providing a plurality of ceiling tiles having a top portion and a bottom portion positioned within the plurality of ceiling tile frames;

(c) providing mating means for attaching the plurality of ceiling tiles to the plurality of ceiling tile frames;

(d) positioning the plurality of ceiling tiles within the plurality of ceiling tile frames and securing the mating means to seal the plurality of ceiling tiles to the plurality of ceiling tile frames;

(e) providing a sealing means for preventing contaminants from passing between each of the plurality of adjacent ceiling tile frames; the sealing means being fixedly attached to the attached frames;

(f) providing a hanging means for hanging the ceiling tile frames within the building; and (g) hanging the ceiling tile frames from the building interior to thereby provide a suspended ceiling which allows containment on contaminants within the area above the ceiling system.

27. The method as defined in claim 26 further comprising the steps of:

(h) providing an adjusting means associated with the hanging means; and (i) adjusting the position of the suspended ceiling from the building floor.

28. The method as defined in claim 26 further providing the steps of:

(h) providing a radio shielding means for each ceiling tile; and (i) attaching the radio shielding means to each ceiling tile thereby shielding radio waves from passing into the area below the bottom portion of the ceiling tile.

* * * * *